US007975355B2

(12) United States Patent
Nauche et al.

(10) Patent No.: US 7,975,355 B2
(45) Date of Patent: Jul. 12, 2011

(54) DEVICE AND A METHOD FOR ADJUSTING THE DRILLING DIRECTION OF A TOOL FOR DRILLING AN OPHTHALMIC LENS

(75) Inventors: Michel Nauche, Charenton (FR); Jean-Michel Bargot, Charenton (FR)

(73) Assignee: Essilor International (Compagnie d'Optique), Charenton-le-Pont (FR)

( * ) Notice: Subject to any disclaimer, the term of this patent is extended or adjusted under 35 U.S.C. 154(b) by 1119 days.

(21) Appl. No.: 11/665,607

(22) PCT Filed: Aug. 4, 2005

(86) PCT No.: PCT/FR2005/002028

§ 371 (c)(1), (2), (4) Date: Apr. 18, 2007

(87) PCT Pub. No.: WO2006/042917

PCT Pub. Date: Apr. 27, 2006

(65) Prior Publication Data

US 2009/0047081 A1 Feb. 19, 2009

(30) Foreign Application Priority Data

Oct. 20, 2004 (FR) ..... 04 11174

(51) Int. Cl.
*B23P 23/00* (2006.01)

(52) U.S. Cl. ..... 29/26 A; 29/28; 29/27 R; 408/236; 408/237; 409/201; 451/255; 451/65; 451/71; 451/325

(58) Field of Classification Search ..... 29/26 A, 29/26 R, 27 C, 27 R, 28; 408/234, 236, 237; 409/201, 211, 216, 199–200; 451/65, 71, 69, 67, 255, 256, 277, 325
See application file for complete search history.

(56) References Cited

U.S. PATENT DOCUMENTS

| | | | | |
|---|---|---|---|---|
| 5,544,989 | A * | 8/1996 | Erath | 408/236 |
| 5,702,212 | A * | 12/1997 | Erath et al. | 408/236 |
| 6,045,307 | A * | 4/2000 | Ikoma et al. | 409/201 |
| 6,785,585 | B1 | 8/2004 | Gottschald | |
| 6,790,124 | B2 * | 9/2004 | Shibata | 451/5 |
| 7,617,579 | B2 * | 11/2009 | Natsume | 29/26 A |
| 2004/0058624 | A1 | 3/2004 | Suzuki et al. | |

FOREIGN PATENT DOCUMENTS

| | | |
|---|---|---|
| DE | 195 24 391 | 1/1996 |
| JP | 61-236411 A * | 10/1986 |
| JP | 08 155945 | 6/1996 |

* cited by examiner

*Primary Examiner* — Erica E Cadugan
(74) *Attorney, Agent, or Firm* — Young & Thompson

(57) ABSTRACT

A device includes pivoting elements enabling the drilling axis (A6) of the drilling tool (35) to be pivoted (PIV) about the axis of orientation, and elements for adjusting the angular position of the drilling tool (35) about the axis of orientation. It also includes first mobility members enabling relative mobility of the drilling tool (35) in relation to the lens to be drilled (L), or vice-versa, according to a first degree of mobility (ESC) which is distinct from the pivoting of the drilling axis of the drilling tool (35) about the axis of orientation. The elements for adjustment are configured so as to control the pivoting of the drilling axis (A6) of the drilling tool (35) about the axis of orientation, in favor of the first degree of relative mobility of the drilling tool (35) in relation to the lens (L) that is to be drilled.

17 Claims, 10 Drawing Sheets

Fig.1
PRIOR ART
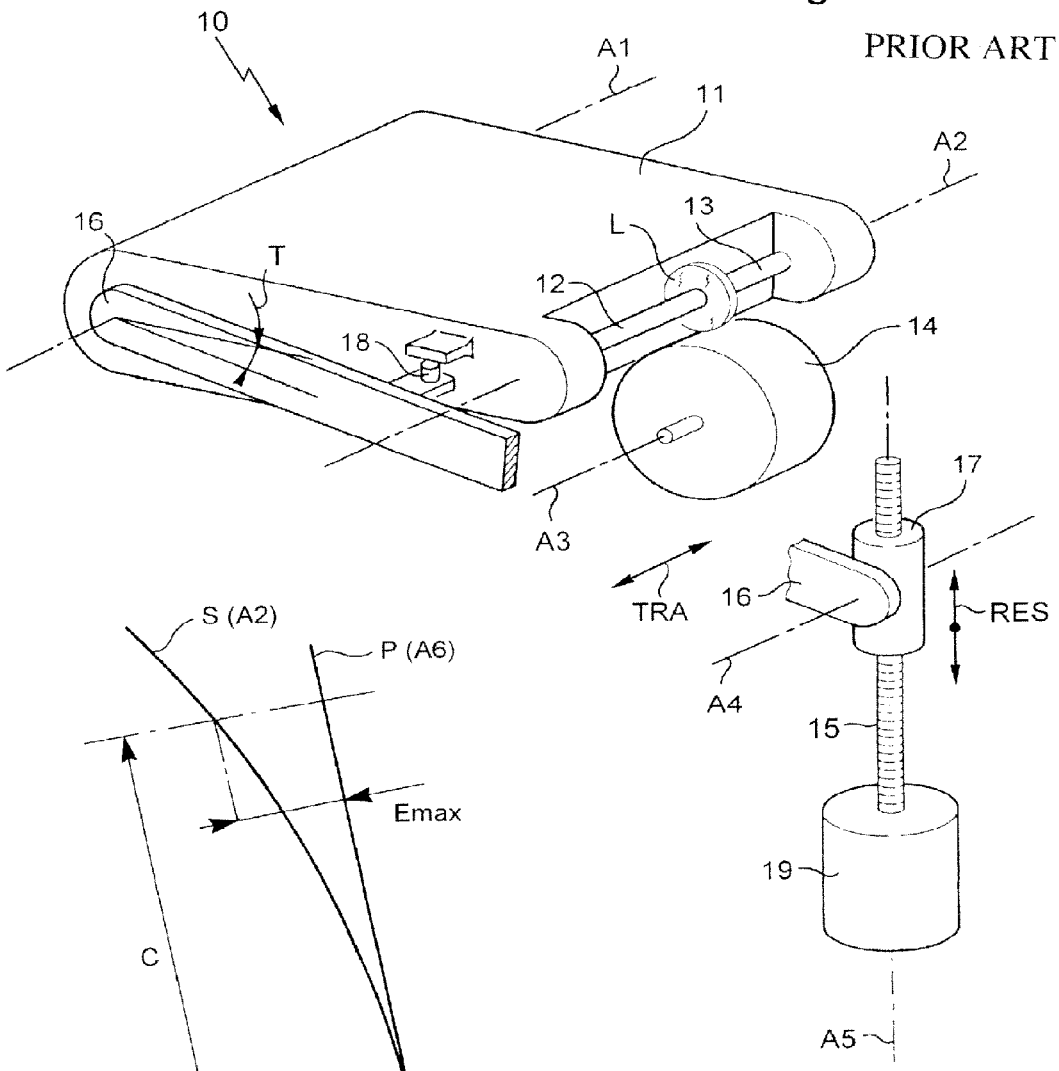
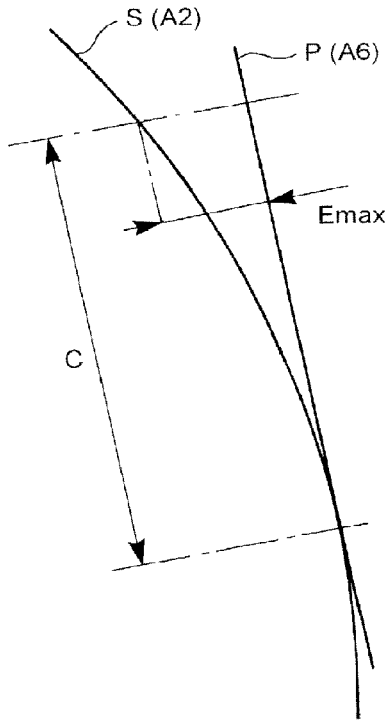
Fig.13

Fig.4
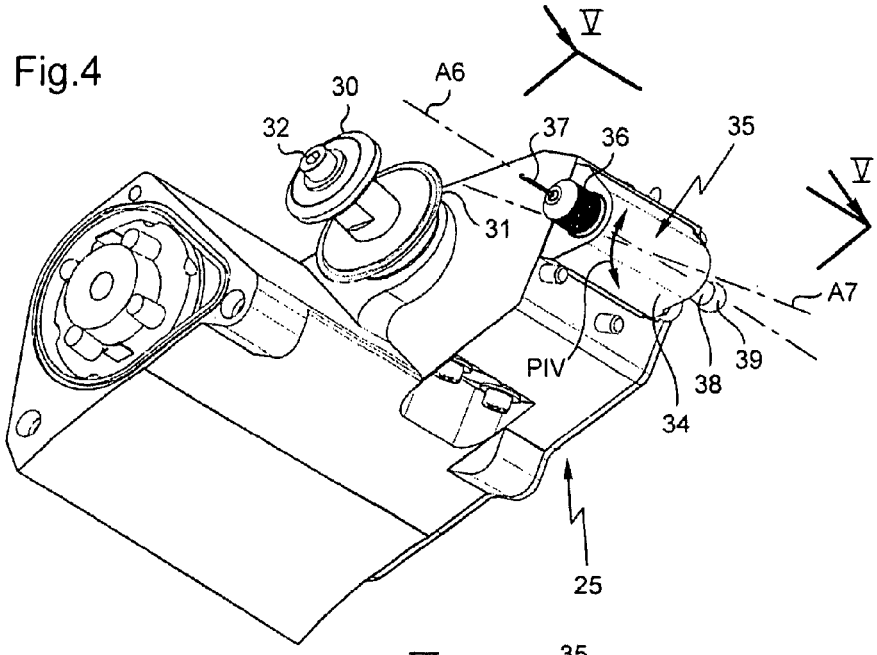
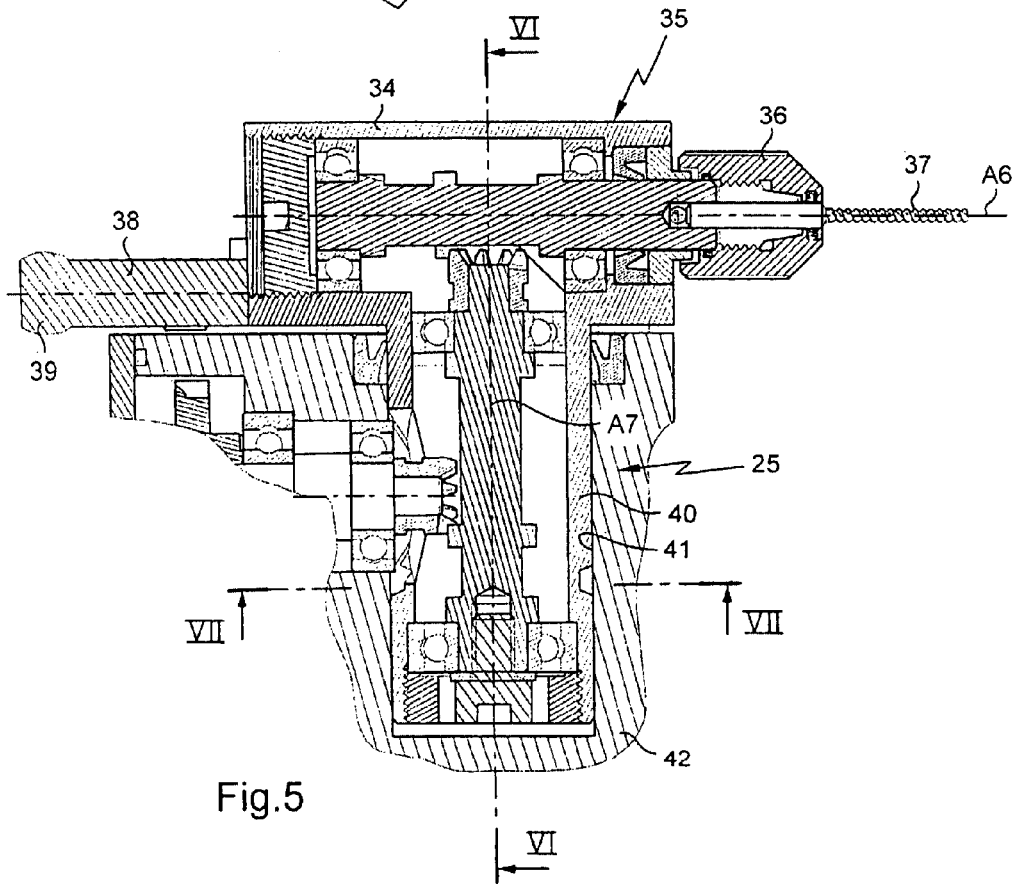
Fig.5

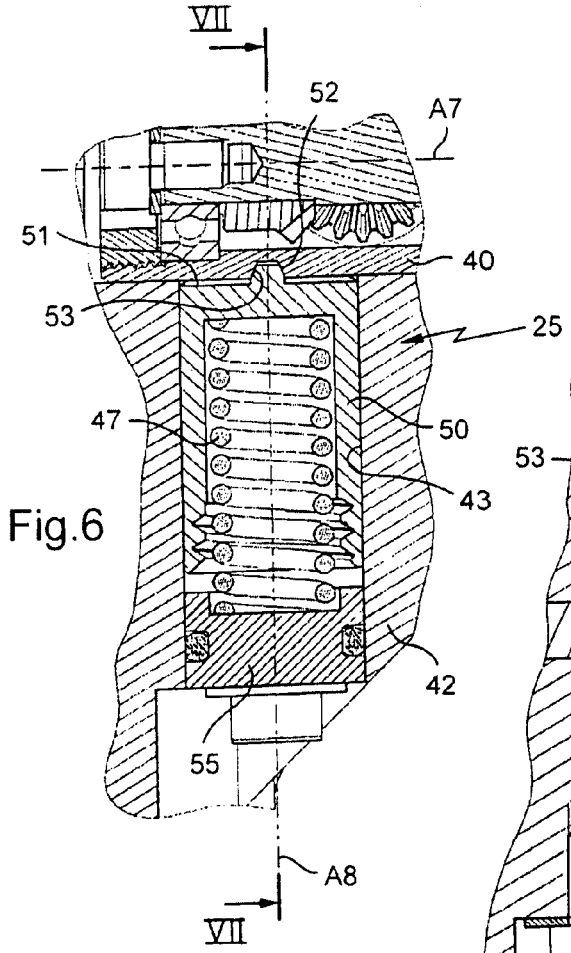
Fig.6
Fig.7
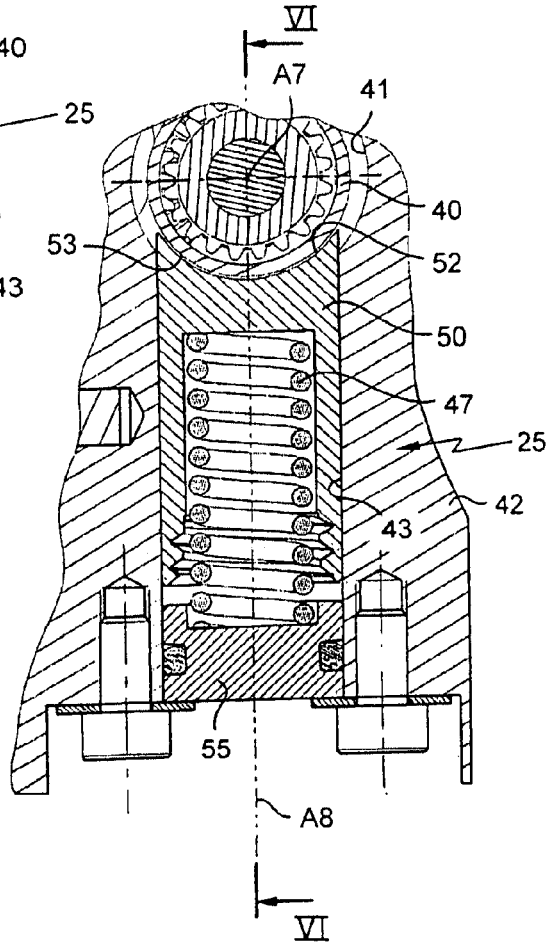
Fig.8
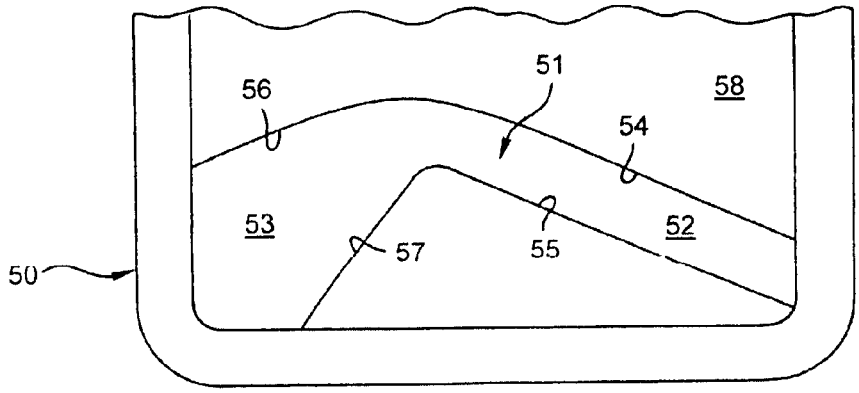

DEVICE AND A METHOD FOR ADJUSTING THE DRILLING DIRECTION OF A TOOL FOR DRILLING AN OPHTHALMIC LENS

TECHNICAL FIELD TO WHICH THE INVENTION RELATES

The present invention relates in general to mounting the ophthalmic lenses of a pair of correcting eyeglasses on a frame, and it relates more particularly to a method and to a device for adjusting the orientation of a tool for drilling an ophthalmic lens.

TECHNOLOGICAL BACKGROUND

The technical portion of an optician's profession consists in mounting a pair of ophthalmic lenses in or on a frame that has been selected by the wearer, in such a manner that each lens is properly positioned relative to the corresponding eye of the wearer so as to best perform the optical function for which the lens was designed. To do this, it is necessary to perform a certain number of operations.

Once the frame has been selected, the optician must begin by situating the position of the pupil of each eye in the frame of reference of the frame. The optician thus determines mainly two parameters that are associated with the morphology of the wearer, namely the pupillary distance and the height of the pupil relative to the frame.

As for the frame itself, several alternative types of frame are commonly on offer, including a bezel frame, which is the most widespread, a grooved frame having half-rims (of the Nylor® type), and a rimless frame with drilled holes. The present invention relates to frames of the rimless type. This type of frame is becoming very popular because of the contribution it provides in terms of comfort and appearance.

It is also necessary to identify the shape of the lens that is appropriate for the selected frame, and this is generally done using a template or an appliance specially designed to read the inside perimeter of the rim of the frame, or indeed by means of an electronic file prerecorded or supplied by the manufacturer.

Starting from this geometrical input data, it is necessary to cut each lens to shape. Cutting a lens to shape in order to enable it to be mounted in or on a frame selected by the future wearer consists in changing the outline of the lens so as to cause it to match the frame and/or the shape desired for the lens. Cutting to shape comprises edging for shaping the periphery of the lens, and depending on whether the frame is of the rimmed or rimless type with clamping through fastener holes formed at specific points of the lens, it also comprises beveling and/or drilling the lens appropriately. Edging (or cutting to shape proper) consists in eliminating the unwanted peripheral portion of the ophthalmic lens in question so as to change the outline of the lens from its initial shape, which is usually circular, to the arbitrary shape of the rim of the eyeglasses frame concerned, or merely to the shape desired for its appearance when the frame is of the rimless type. This edging operation is usually followed by a chamfering operation that consists in smoothing or trimming the two sharp edges of the edged lens. Usually these operations of edging, chamfering, and beveling are performed in succession on a common cutting out device which is generally constituted by a grinder machine, referred to as an edger, and fitted with a suitable set of grindwheels.

When the frame is of the rimless type, having drilled lenses, the edging of the lens, and possibly the flattening of the sharp edges (chamfering) are followed by appropriate drilling of the lenses for mounting the temples and the bridge for the nose of the rimless frame. Drilling can be performed on the edger providing it is fitted with the corresponding tooling, or it can be performed on a distinct drilling machine. In the context of the present invention, attention is paid in general to the accuracy and to the expense of the various degrees of freedom in movement used for drilling purposes. In addition to this general problem, the invention relates more specifically to drilling performed on the grinder, or more generally on the machine that includes cutting-out means. The machine is then provided not only with cutting-out means, but also with means specifically for drilling.

At present, lenses are usually drilled by manual finishing-off operations. Accuracy thus depends directly on the dexterity of the operator performing the drilling operation.

Recently, partially-automatic drilling devices that are integrated in edger machines have appeared on the market. The contribution of integrating such a function within the machine that performs edging on the lens is manifest, both in terms of operator convenience in performing the operation and in terms of the increase in accuracy procured thereby.

Amongst the technical and economic difficulties that result from this added function, the main difficulty is due to the fact that drilling of quality that is high, as understood in the profession, needs to be performed in such a manner that the axis of the hole that results from the drilling is normal to the tangent at the point of drilling. Installing this orientation function leads to a novel architecture being devised for the machine, given the size of the actuators and encoders that need to be put into place. This difficulty has led certain manufacturers purely and simply to eliminate this function of orienting the drilling axis, which then becomes fixed and parallel to the axis of rotation of the lens. This leads to a function that rapidly presents limits on its suitability for use with lenses that present curvature on the front face.

Concretely, a grinder for edging lenses mainly comprises a frame carrying firstly a machining station that is fitted with one or more edging grindwheels and one or more bevel grindwheels, and possibly chamfering grindwheels, mounted to rotate about an axis under the control of a drive motor, and secondly a carriage that is fitted parallel to the axis of said grindwheels, with two shafts on the same axis for blocking and rotating the lens. These two shafts are mounted to turn about their common axis (which is also the blocking axis) under the control of one or two drive motors and to slide axially relative to each other under the control of another motor. Each of the two shafts possesses a free end facing the free end of the other shaft, and these facing free ends of the two shafts are thus suitable for blocking a lens to be treated by clamping it axially.

The carriage is mounted to move relative to the frame, firstly transversely relative to the axis of the grindwheels, under the control of thrust means urging it along said axis (following a movement referred to as "reproduction"), and secondly axially, parallel to the axis of the grindwheels, under control of suitable control means (often referred to as "transfer" means).

In order to be moved transversely relative to the axis of the grindwheels (reproduction), as is necessary for applying the ophthalmic lens for treatment against the grindwheels so as to reproduce the various radii that the outline of the desired lens is to describe, the carriage may be mounted to pivot parallel to said axis (in which case the carriage is usually referred to as a "rocker"), or else it is mounted to move in translation perpendicularly thereto.

Drilling and/or grooving and/or chamfering modules may optionally be mounted on a moving support for the purposes, where appropriate, of drilling, or grooving the lens after it has been edged.

OBJECT OF THE INVENTION

An object of the present invention is to provide a solution to the above-mentioned problem of accuracy and expense.

To this end, the invention provides a device for adjusting the orientation of the drilling axis of a drilling tool for drilling an ophthalmic lens, said adjustment being about at least one swivel axis extending substantially transversely to said drilling axis, the lens being secured to a support that is capable of rotating about a lens rotation axis, the device comprising: pivot means enabling the drilling axis of the drilling tool to perform pivoting movement about said swivel axis relative to said axis of rotation of the lens support; and adjustment means for adjusting the angular position of the drilling tool about said swivel axis, the device comprising first movement means for enabling the drilling tool to move relative to the lens to be drilled, or vice versa, with a first degree of freedom in movement distinct from the pivoting of the drilling axis of the drilling tool about said swivel axis, said adjustment means being arranged to control pivoting of the drilling axis of the drilling tool about said swivel axis by means of said first degree of freedom in relative movement of the drilling tool relative to the lens to be drilled.

In analogous manner, the invention also provides a method of adjusting the orientation of the drilling axis of a drilling tool for drilling an ophthalmic lens, orientation being adjusted about at least one swivel axis that is substantially transverse to said drilling axis, including pivoting of the drilling axis about said swivel axis, the method being characterized in that in order to adjust the orientation of the drilling axis, the pivoting of the drilling axis about said swivel axis is controlled by a first relative moment in translation or in tilting of the drilling tool relative to the lens to be drilled, distinct from the pivoting of the drilling axis of the drilling tool about said swivel axis.

This enables the orientation of the drilling axis of the drilling tool to be adjusted simply and accurately by making use of the degrees of freedom in movement of other members of the drilling and optionally edging machine on which the adjustment device is installed. It is found that the drilling tool can be pivoted about the swivel axis by using the means for providing transverse movements, instead of using specific means that serve solely to pivot the drilling tool. Such means for imparting transverse movements to the drilling tool are in any event needed for adjusting the relative position of the drilling tool relative to the lens in order to position the drilling tool appropriately in register with the location where the lens is to be drilled. In addition, in order to perform this position adjustment, these transverse movement means need to be accurate. Thus, the invention provides a saving in means by giving the transverse movement means not only their main function of adjusting the position of the drilling tool in the plane of the lens, but also a second function of adjusting the orientation of the axis of said drilling tool relative to the lens so as to drill the lens along a desired orientation.

This thus provides the following advantages:

- it is possible to integrate the invention in existing equipment;
- the orientation is adjusted with high accuracy;
- axes already present on the machine are used for performing the orientation function;
- there is no need to add any additional actuators or encoders;
- there is a saving in the overall volume of the machine fitted in this way; and
- there is a saving in price.

DETAILED DESCRIPTION OF AN EMBODIMENT

The following description with reference to the accompanying drawings of an embodiment and given by way of non-limiting example makes it clear what the invention consists in and how it can be implemented.

In the accompanying drawings:

FIG. 1 is a general diagrammatic view in perspective of an edger;

FIG. 4 is a detail view in perspective showing the drilling module on its own, from yet another angle;

FIG. 5 is a section view of the drilling module on plane V of FIG. 4 containing the axis of the drill bit;

FIG. 6 is a section view on plane VI-VI of FIG. 5, showing in particular the means for braking the orientation pivoting of the drilling tool;

FIG. 7 is a section view on plane VII-VII of FIG. 6;

FIG. 8 is a detail view of the face of the cam-forming portion of the adjustment means;

FIG. 13 is a diagram showing the unwanted displacement along the orientation axis of the drilling tool;

Figure 14:
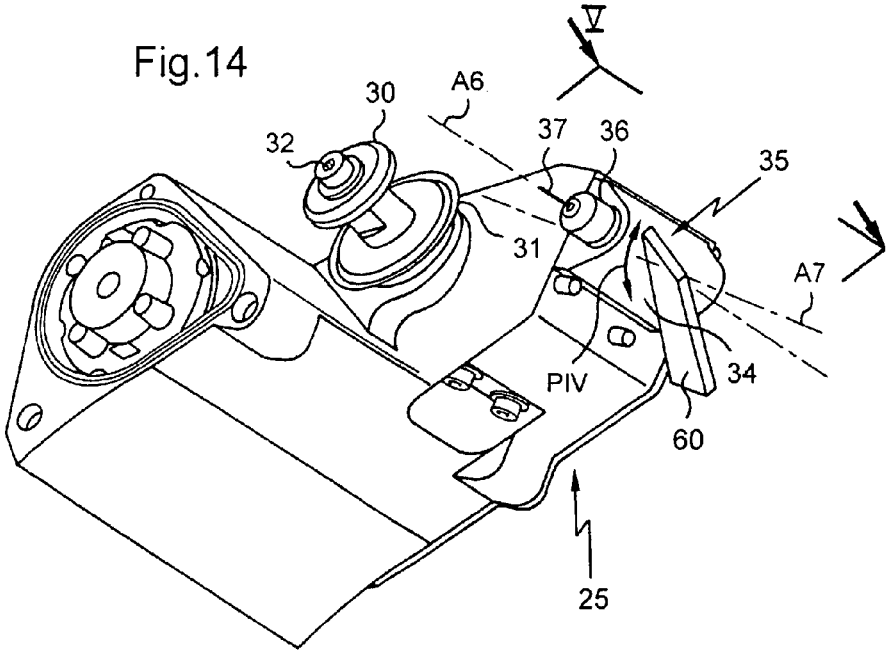
Figure 15:
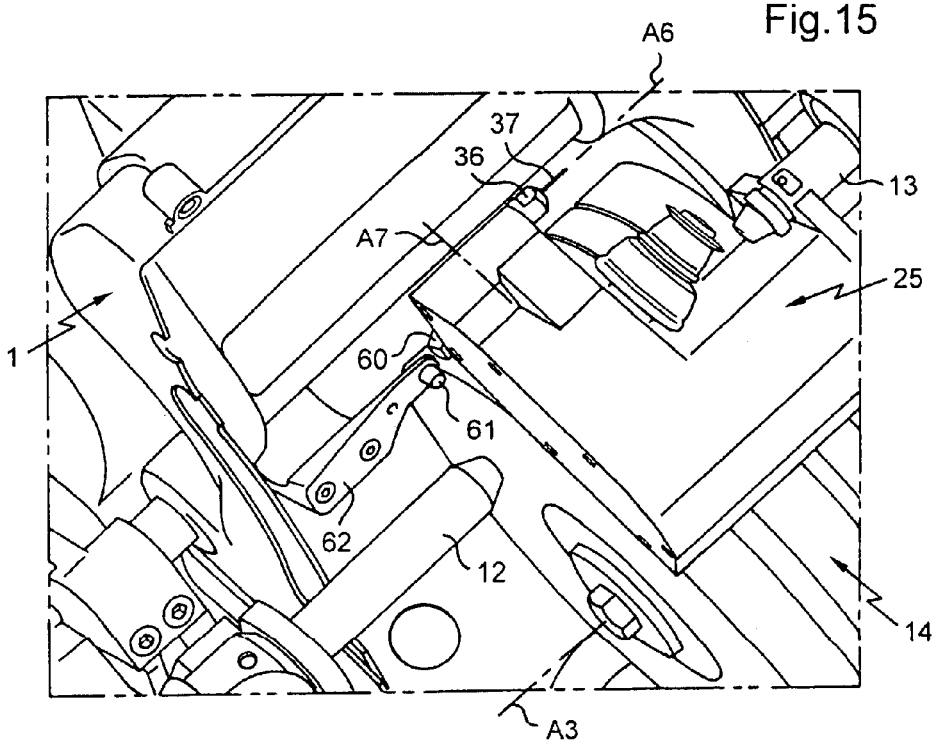

FIG. 14 is a view analogous to FIG. 4, showing another embodiment in which the pivoting of the drilling axis about its orientation axis is controlled by a displacement in a direction substantially parallel to the axis of the lens to be drilled; and FIG. 15 is a perspective view of the FIG. 14 embodiment, showing the co-operation between a ramp-lever associated with the drilling body and a stationary tilting abutment associated with the structure of the device.

The edger device of the invention can be implemented in the form of any machine tool for cutting away or removing material that is suitable for modifying the outline of an ophthalmic lens in order to fit it to the rim of a selected frame. By way of example, such a machine tool may be a grinder as in the example described below, or a mechanical cutter, or a laser or waterjet cutter, etc.

In the example shown diagrammatically in FIG. 1, the edger comprises in conventional manner, an automatic grinder 10, commonly said to be a numerically-controlled grinder. Specifically, the edger includes a rocker 11 mounted to pivot freely about a first axis A1, in practice a horizontal axis, on a frame 1. This pivoting is controlled as described in detail below.

For holding and rotating an ophthalmic lens such as L that is to be machined, the edger is fitted with two shafts 12 and 13 for clamping and providing rotary drive. These two shafts 12 and 13 are in alignment with each other along a second axis A2, referred to as a blocking axis, that is parallel to the first axis A1. The two shafts 12 and 13 are driven to rotate synchronously by a motor (not shown) via a common drive mechanism (not shown) on board the rocker 11. This common mechanism for synchronous drive in rotation is of ordinary type and known in itself.

In a variant, provision could also be made to drive the two shafts by means of two distinct motors that are synchronized either mechanically or electronically.

The rotation ROT of the shafts 12, 13 is controlled by a central electronic and computer system (not shown) such as an integrated microcomputer or a set of application-specific integrated circuits (ASICs).

Each of the shafts 12, 13 possesses a free end facing the other free end and fitted with a respective blocking chuck 62, 63. The two chucks 62, 63 are generally circularly symmetrical about the axis A2, and each presents a generally transverse application face 64, 65 that is arranged to bear against the corresponding face of the ophthalmic lens L.

In the example shown, the chuck 62 is a single piece and it is fastened without any degree of freedom in movement, neither in sliding nor in rotation, to a free end of the shaft 12. The chuck 63 comprises two portions: an application pellet 66 for co-operating with the lens L and presenting, for this purpose, a working face 65 and a shank 67 for co-operating with the free end of the shaft 13 as described in greater detail below. The pellet 66 is attached to the shank 67 by a cardan connection 68 that transmits rotation about the axis A2 while also allowing the pellet 66 to swivel about any axis perpendicular to the axis A2. The working faces 64, 65 of the chuck are preferably covered in a thin lining of plastics material or of elastomer material. The thickness of the lining is of the order of 1 millimeter (mm) to 2 mm. It may be constituted by a flexible polyvinyl chloride (PVC) or by a neoprene, for example.

The shaft 13 is movable in translation along the blocking axis A2, facing the other shaft 12, so as to clamp the lens L in axial compression between the two blocking chucks 62, 63. The shaft 13 is controlled to perform this axial translation by a drive motor acting via an actuator mechanism (not shown) controlled by the central electronic and computer system. The other shaft 12 is stationary in translation along the blocking axis A2.

The edger device also comprises a set of at least one grindwheel 14 which is constrained to rotate on a third axis A3 parallel to the first axis A1 and which is likewise appropriately driven in rotation by a motor (not shown). For reasons of simplicity, the axes A1, A2, and A3 are represented by chain-dotted lines in FIG. 1 which shows the general principle of the structure of an edger, which structure is in any event known in itself. A more detailed embodiment specific to the invention is shown in FIG. 2 and the following figures.

Figure 2:
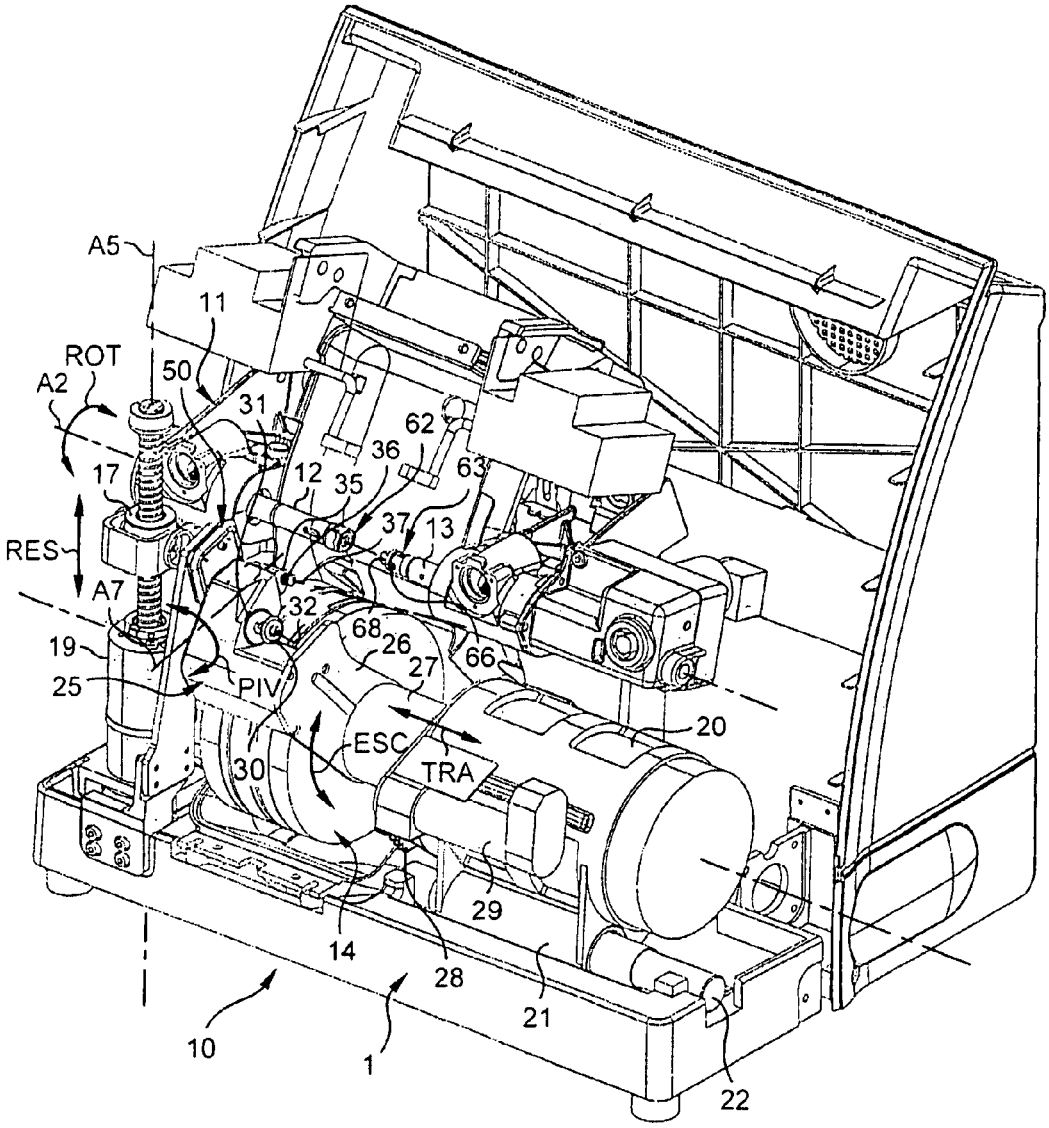
FIG. 2 is a perspective of an edger fitted with a drill bit and a device for adjusting the orientation of said bit in accordance with the invention.
Figure 3:
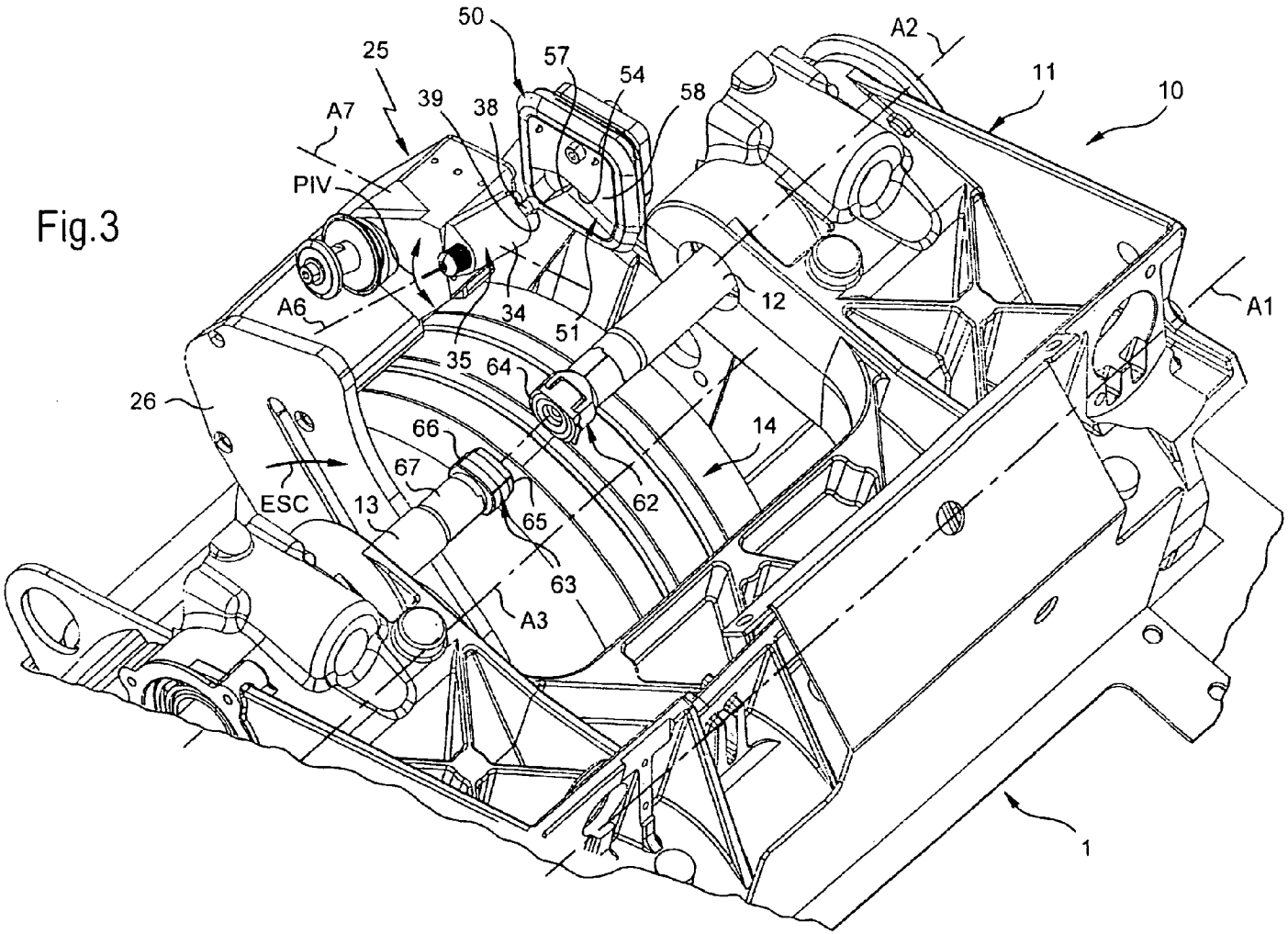
FIG. 3 is a fragmentary perspective view of the FIG. 2 edger, seen from another angle and on a larger scale, showing the device for adjusting the orientation of the drill bit, prior to the finger engaging in the orientation ramp.

In practice, as shown in FIG. 2, the edger 10 has a set comprising a plurality of grindwheels 14 all mounted on the third axis A3 for roughing out and finishing the edging of the ophthalmic lens 12 that is to be machined. Each of these various grindwheels is adapted to the material of the lens being cut to shape and to the type of operation being performed (roughing out, finishing, mineral or synthetic material, etc.).

The set of grindwheels is fitted on a common shaft of axis A3 serving to drive them in rotation during the edging operation. This common shaft (not visible in the figures) is rotated by an electric motor 20 controlled by the electronic and computer system.

The set of grindwheels 14 is also movable in translation along the axis A3, with this movement in translation being controlled by a motor. Specifically, the entire set of grindwheels 14, together with its shaft and its motor is carried by a carriage 21 which is itself mounted on slides 22 secured to the structure 1 so as to slide along the third axis A3. The movement in translation of the grindwheel-carrying carriage 21 is referred to as transfer and is referenced TRA in FIG. 2. This transfer is controlled by a motor-driven mechanism (not shown), such as a nut-and-screw system or a rack system, controlled by the central electronic and computer system.

In order to enable the spacing between the axis A3 carrying the grindwheels 14 and the axis A2 of the lens to be varied during edging, use is made of the ability of the rocker 11 to pivot about the axis A1. This pivoting leads to movement, in this case substantially vertical movement, of the lens L clamped between the shafts 12 and 13, thereby moving the lens towards or away from the grindwheels 14. This mobility, which makes it possible to reproduce the desired edged shape as programmed in the electronic and computer system is marked RES in the figures. This reproduction movement RES is controlled by the central electronic and computer system.

In the example shown diagrammatically in FIG. 1, in order to perform this reproduction, the edger 10 includes a link 16 that is hinged to the frame 1 about the same first axis A1 as the rocker 11 at one of its ends, and that is hinged at its other end about a fourth axis A4 parallel to the first axis A1 to a nut 17 mounted to move along a fifth axis A5 referred to as a reproduction axis, that is perpendicular to the first axis A1 and that also includes a contact sensor 18 that co-operates with said link 16 and the rocker 11. By way of example, this contact sensor 18 is constituted by a Hall effect cell or is merely an electric contact.

As shown diagrammatically in FIG. 1, the nut 17 is tapped and is in screw engagement with a threaded rod 15 that, in alignment on the fifth axis A5, is rotated by a reproduction motor 19. The motor 19 is controlled by the central electronic and computer system. The pivot angle of the rocker 11 about the axis A1 relative to the horizontal is written T. This angle T is associated with the vertical translation, written R, of the nut 17 along the axis A5. When, suitably clamped between the two shafts 12 and 13, the ophthalmic lens L for machining is brought into contact with the grindwheel 14, material is indeed removed therefrom until the rocker 11 comes into abutment against the link 16 by bearing against it at the contact sensor 18, this being detected by the sensor.

In a variant, as shown in FIG. 2, provision is made for the rocker 11 to be hinged directly to the nut 17 mounted to move along the reproduction axis A5. A strain gauge is associated with the rocker to measure the machining advance force applied to the lens. Thus, throughout machining, the grinding advance force applied to the lens is measured continuously and the progress of the nut 17, and thus of the rocker 11 is controlled so that this force remains below a maximum setpoint value. For each lens, this setpoint value is adapted to the material and to the shape of the lens.

In any event, for machining the ophthalmic lens L around a given outline, it suffices firstly to move the nut 17 accordingly along the fifth axis A5 under the control of the motor 19 so as to control the reproduction movement, and secondly to cause the support shafts 12 and 13 to pivot together about the second axis A5, in practice under the control of the motor controlling them. The transverse reproduction movement RES of the rocker 11 and the rotary movement ROT of the shafts 12 and 13 holding the lens are controlled together by an electronic computer system (not shown), suitably programmed for this purpose, so that all of the points on the outline of the ophthalmic lens L are brought in succession to the appropriate diameter.

The edger shown in FIG. 2 also has a finishing module 25 carrying chamfering and grooving wheels 30, 31 mounted on a common shaft 32 that is movable with one degree of freedom in a direction substantially transverse relative to the axis A2 of the shafts 12 and 13 holding the lens and the reproduction axis A5. This degree of freedom in movement is referred to as retraction and is written ESC in the figures.

Specifically, this retraction consists in the finishing module 25 pivoting about the axis A3. Concretely, the module 25 is carried by an arm 26 secured to a tubular sleeve 27 mounted on the carriage 21 to pivot about the axis A3. To control its pivoting, the sleeve 27 is provided at its end remote from the arm 26 with a toothed wheel 28 that meshes with a gearwheel (not shown in the figures) fitted to the shaft of an electric motor 29 secured to the carriage 21.

In summary, it can be seen that the degrees of freedom in movement that are available on such an edger are as follows:

- rotation of the lens, enabling the lens to be turned about the axis holding it, which axis is substantially normal to the general plane of the lens;
- reproduction, consisting in transverse relative movement between the lens and the grindwheels (i.e. movement in the general plane of the lens), enabling the different radii that describe the outline of the shape desired for the lens to be reproduced;
- transfer, consisting in the lens moving axially (i.e. perpendicularly to the general plane of the lens) relative to the grindwheels, enabling the lens to be positioned in register with the desired edging grindwheel; and
- retraction, consisting in the finishing module moving transversely in a direction that is different from the reproduction direction relative to the lens so as to enable the finishing module to be moved into its in-use position and into its storage position.

In this context, the general object of the invention is to include a drilling function in the edger. For this purpose, the module 25 is provided with a drill 35 whose spindle is fitted with a chuck 36 for holding a drill bit 37 on a drilling axis A6.

The drill 35 is mounted on the module 25 to pivot about a swivel axis A7 that is substantially transverse to the axis A3 of the grindwheels 14 and to the reproduction axis A5, and is thus substantially parallel to the retraction direction ESC of the module 25. The drilling axis A6 can thus be pivoted about the swivel axis A7, i.e. in a plane that is close to being vertical. This pivoting of the drill 35 is written PIV in the figures. This is the only degree of freedom in movement dedicated to drilling.

Integrating the drilling function within an edger nevertheless implies that the drilling tool must be properly positioned in register with the position of the hole that is be drilled in the lens. In the invention it is desired to achieve this positioning while optimizing the use of the already-existing degrees of freedom in movement for machining, and above all while avoiding creating additional degrees of freedom in movement and/or additional control mechanisms that are dedicated to drilling.

In accordance with the invention, this positioning is performed by using two pre-existing degrees of freedom in movement, independently of the drilling function, namely retraction ESC and transfer TRA. These two degrees of freedom in movement, in retraction and in transfer, are used in addition to orient the drilling axis A6 of the drill 35.

Thus, to implement the drilling function, the module 25 is controlled to pivot about the axis A3 (retraction ESC) in order to adopt a plurality of main angular positions, including:

- a storage position (not shown) in which it is far away from the lens-holding shafts 12, 13 and in which it is stored under a protective cover (not shown) while not in use, thereby releasing the space needed for machining the lens on the grindwheels 14 without any risk of conflict;
- a range of positions for adjusting the orientation of the drill 35, in which the orientation of the drilling axis A6 of the bit 37 is adjusted about the axis A7, as explained in detail below; and
- a drilling position that is identical from one lens to another, in which the bit 37 of the drill 35 is positioned between the lens-holding shafts 12, 13 and the grindwheels 14, substantially vertically above the axis A2, or more generally on or near the path followed by the axis A2 of the lens (in cylindrical space) during its reproduction RES working stroke during drilling, as described in detail below.

The storage position does not in itself form the subject of the present invention and is therefore not described in greater detail.

The orientation of the drilling axis A6 of the drill 35 about the axis A7 is adjusted using the means and in the manner described below with reference more particularly to FIG. 4 et seq.

To be pivotally mounted on the module 25, the body 34 of the drill 35 possesses a cylindrical sleeve 40 of axis A7 that is pivotally received in a corresponding bore 41 on the same axis A7 formed in the body 42 of the module 25. The drill 35 can thus pivot about the swivel axis A7 over a range of angular positions corresponding to inclinations of the drilling axis A6 relative to the lens for drilling when the module 25 moves into the drilling position. This range of angular positions is physically defined by two angular abutments secured to the body 42 of the module 25 and visible in FIG. 4.

The pivoting of the sleeve 40 about the axis A7 is continuously braked by friction brake means. These brake means are implemented in this example in the form of a drum type brake, comprising a piston 50 of axis A8 substantially to the axis A7. This piston is received in a bore 43 of axis A8 that opens out to the inside of the bore 41 of the sleeve 40. The piston 50 can thus slide along the axis A8. It possesses an end 51 situated facing the sleeve 40 of the drill 35 and provided with a projection 52 of trapezoidal section forming a crescent-shaped brake segment suitable for co-operating with a corresponding slot 53 of trapezoidal section formed in the outside face of the sleeve 40, which thus forms the brake drum. A return spring 47 is received in part inside the piston 50, which is hollow. This spring is compressed between the end wall of the hollow portion of the piston 50 and a stopper 55 fitted in the bore 43 of the body 42 of the module 25. The segment 52 of the piston 50 is thus continuously urged against the sleeve 40 of the drill 35 in order to exert braking friction against pivoting of the sleeve 40 of the drill 35 about the swivel axis A7. In order to perform this braking function as well as possible, the segment 52 and/or the slot 53 may be provided with a suitable friction lining.

In the example shown, the brake piston 50 is not declutchable and it therefore exerts its braking action continuously. Nevertheless, it is possible to envisage providing means for declutching the braking of the drill pivoting about its swivel axis. Such clutch means can then be activated while engaging means for adjusting the orientation of the drill.

The braking that is obtained must be sufficiently strong to withstand the torque generated during drilling by the drilling and contouring forces.

The braking means of the drilling tool prevent pivoting of the tool for torque that is less than or equal to 30 Newton-centimeters (N.cm).

The means for adjusting the orientation of the drilling axis A6 of the drill 35 about the swivel axis A7 comprise two portions that move relative to each other with two degrees of freedom in movement: one degree of freedom in engagement that enables the two portions to be engaged and disengaged mutually, and one degree of freedom in adjustment that makes it possible, after the two portions of the adjustment means have been engaged, for them to co-operate dynamically to cause the drill 35 to pivot about the swivel axis A7 in order to adjust the inclination of the drilling axis A6 about the axis A7.

In the example shown, the adjustment means comprise firstly a finger 38 secured to the body 34 of the drill 35 and provided with a spherical end 39, and secondly a plate 50 having a cam path 51 and secured to the structure 1 of the edger.

The plate 50 presents a plane working face 58 which is substantially perpendicular to the transfer direction TRA, or in other words, in the example, the axes A2 and A3. Since the axes A2 and A3 are horizontal in this example, the working face 58 of the plate 50 is vertical. When the module 25 is in the adjustment angular range, as shown in FIGS. 2, 3, 9, 10, 11, and 12, the working face 58 of the plate 50 is situated facing the end 39 of the finger 38 of the drill 35.

The cam path of the plate 50 is constituted by a trench 51 set back in the working face 58 of the plate 50. This trench which can be seen more clearly in FIG. 8 is generally in the form of an upside-down V-shape with its limbs constituting two portions having distinct functions:

- a docking or engagement zone 53 serving to dock and engage the end 39 of the finger 38, and also to initialize inclining the drill 35 about the swivel axis A7; and
- an adjustment portion 52 serving to adjust the inclination of the drill 35 about the swivel axis A7.

The engagement zone 53 of the trench 51 is of flared shape going towards the storage position of the module 25 so as to allow the end 39 of the finger 38 to engage in the trench 51 whatever the inclination of the drill 35 about the swivel axis A7 within the angular range defined by the angle abutments of the module 25. The engagement zone 53 of the trench possesses a top wall 56 and a bottom wall 57 that are plane or slightly curved and that form between them a dihedral angle of more than 20°, e.g. of 35°. The bottom wall 57 presents an upward slope relative to the direction of the retraction movement ESC of the module 25 towards the drilling position.

The adjustment portion 52 possesses a top wall 54 and a bottom wall 55 that are parallel, and relative to the direction of retraction movement ESC of the module 25 (which direction is substantially horizontal), with a slope of sign opposite to that of the reinitialization ramp 57. This slope is thus downward in this example relative to the direction of retraction movement ESC of the module 25 towards the drilling position.

This embodiment of the adjustment means, making use of a cam, is not limiting. In a variant, alternative solutions could be provided for adjusting the orientation of the drill 35, such as, for example:

- replacing the cam by a toothed sector;
- replacing the orientation finger of the drill by a gearwheel driving a wormscrew, itself meshing with a gearwheel secured to the swivel axis A7 of the drill; position would then be maintained by the irreversible nature of the connection between the gearwheel and the wormscrew.

In any event, in operation, the inclination of the drilling axis A6 about the swivel axis A7 is adjusted automatically under the control of the electronic and computer system by making use of the ability of the module to perform transfer and retraction movements (TRA and ESC), thereby causing the finger 38 of the drill to co-operate with the cam plate 50, and more precisely firstly with the upwardly-sloping bottom face 57 of the docking and engagement zone 53, then with the top face 54 of the adjustment portion 52. The adjustment operation comprises five steps making use of a degree of freedom in movement of the module 25.

During a first step, the electronic and computer system controls retraction movement so as to bring the module 25 into a predetermined docking position that is always identical in which the end 39 of the finger 38 of the drill 35 is in register with the docking zone 53 of the plate.

Figure 9:
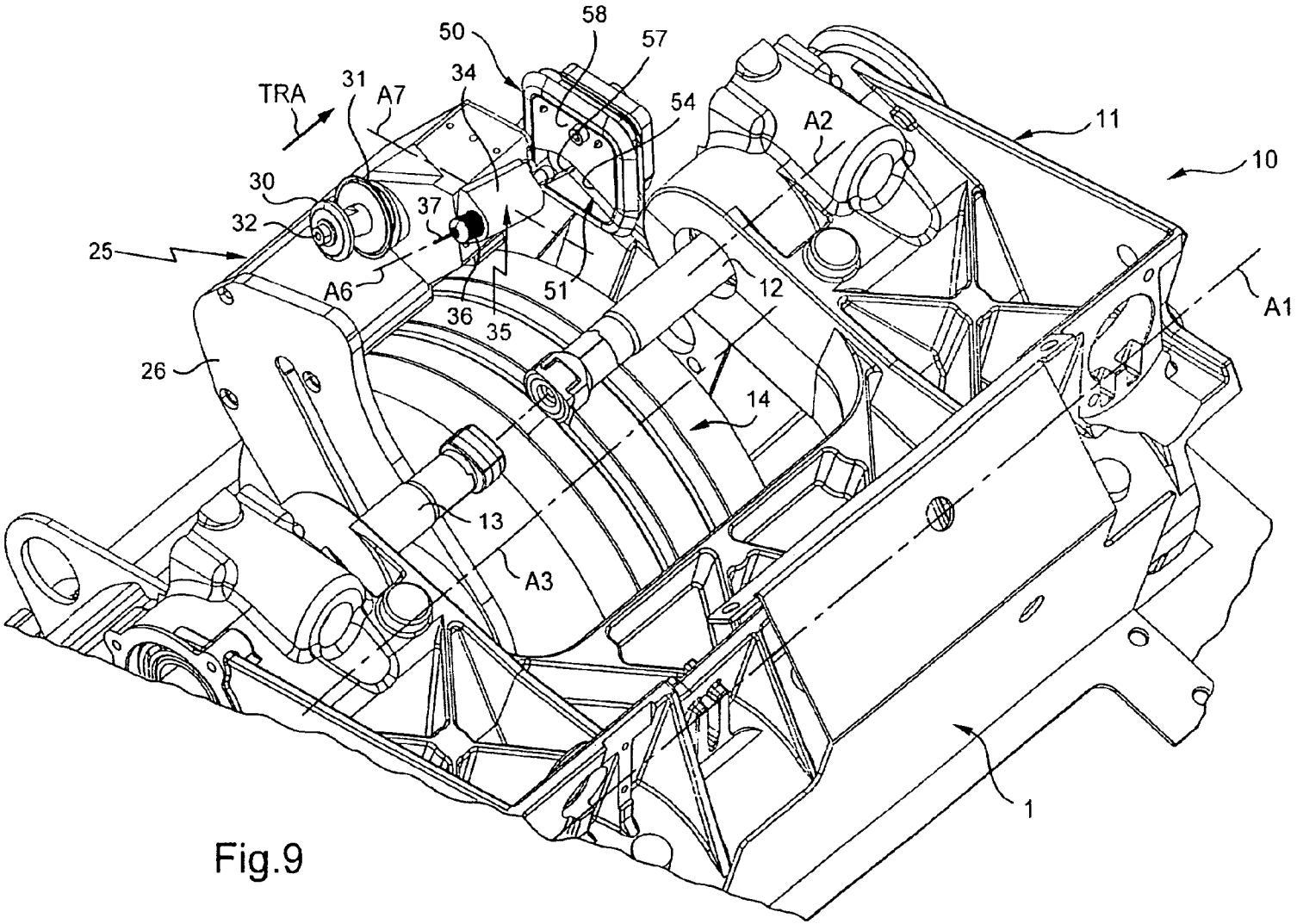
FIG. 9 is a perspective view analogous to FIG. 3, showing the adjustment finger of the drilling tool engaging in a docking zone of the cam of the adjustment means.

During a second step, that may be referred to as the docking step, the electronic and computer system controls transfer movement TRA so as to bring the end 39 of the finger 38 of the drill 35 into the docking zone 53 of the trench 51, as shown in FIG. 9.

It can be seen that the top wall 56 does not perform a mechanical function. It is far enough away from the bottom wall 57 to enable the end 39 of the finger 38 to dock, even when the drill is in an extreme angular position. The end 39 of the finger 38 thus does not come into contact with the top wall 56 at any time.

During the third step, referred to as a reinitialization step, the electronic and computer system controls retraction movement ESC of the module 25 so as to bring it towards the drilling position.

Figure 10:
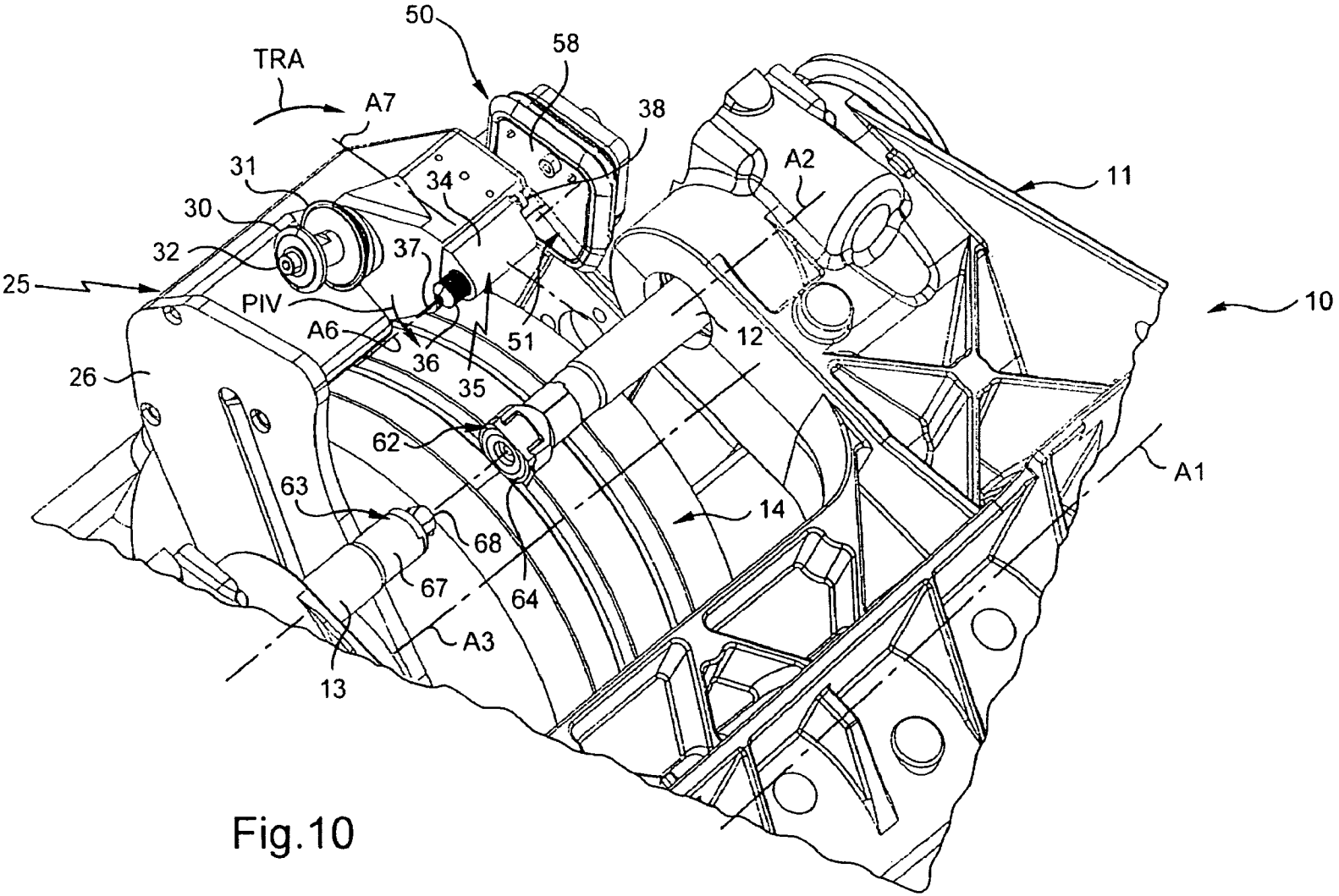
FIG. 10 is a perspective view analogous to FIG. 9, showing the action of the reinitialization ramp on the adjustment finger of the drilling tool.

The reinitialization function of the zone 53 of the trench 51 is exerted by the bottom wall 57 which forms a reinitialization ramp for the end 39 of the finger 38. This reinitialization ramp 57 is arranged obliquely relative to the path followed by the end 39 of the finger 38 of the drill 35 during the retraction pivoting ESC of the module 25, such that during this retraction pivoting of the module 25 towards its drilling position, i.e. towards the lens, the end 39 of the finger 38 engages against the reinitialization ramp 57 and slides thereon, being forced thereby to cause the drill 35 to pivot about the swivel axis A7 towards an initial angular position corresponding to the drilling axis A6 being parallel with the lens holding and rotation axis A2. As shown in FIG. 10, this initial angular position is reached when the spherical end 39 of the finger 38 reaches the top of the reinitialization ramp 57.

During a fourth step, the electronic and computer system continues, as during the preceding reinitialization step, to control retraction movement ESC of the module 25 so as to bring it towards its drilling position. After it has gone past the top of the reinitialization ramp 57, the end 39 of the finger 38 continues its stroke that results from the pivoting ESC of the module 25 towards its drilling position, and it is taken in charge by the adjustment portion 52 of the trench 51.

Figure 11:
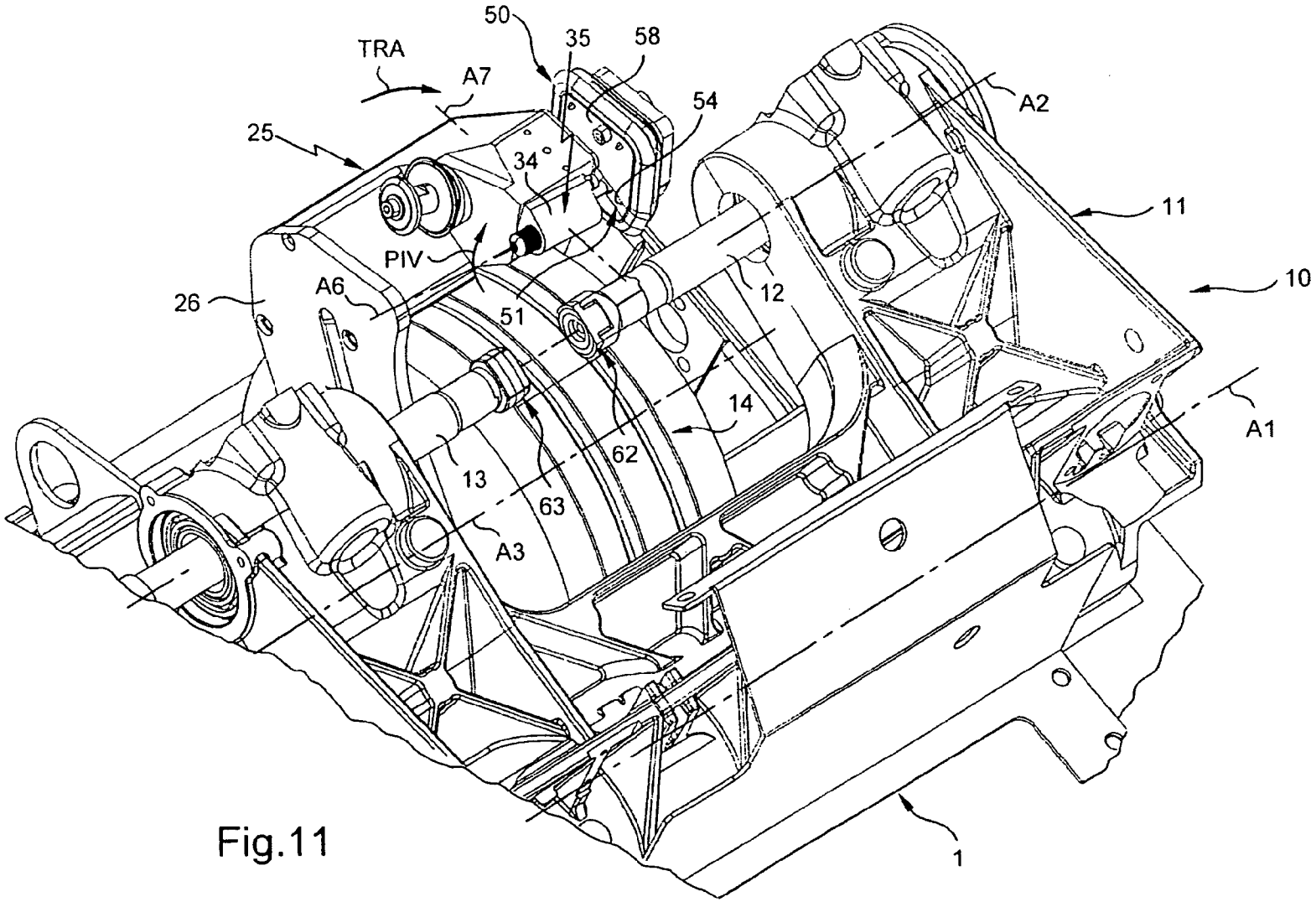
FIG. 11 is a perspective view analogous to FIG. 10, showing the action of the adjustment ramp on the adjustment finger of the drilling tool.

The bottom wall 55 does not perform a mechanical function, and at no time does it come into contact with the end 39 of the finger 38. The function of adjusting the inclination of the adjustment portion 52 is performed by the top wall 54 which forms a ramp for adjusting inclination by engaging the end 39 of the finger 38. This adjustment ramp 54 is arranged obliquely on the path of the end 39 of the finger 38 of the drill 35 as the module 25 performs retraction pivoting ESC. The slope of the adjustment ramp 54 is opposite in sign to that of the reinitialization ramp 57 such that during the retraction pivoting of the module 25 towards its drilling position, i.e.

towards the lens, and after passing the top of the reinitialization ramp 57, the end 39 of the finger 38 engages against the adjustment ramp 54 and slides thereon, being forced thereby to cause the drill 35 to pivot about the swivel axis A7 from its initial angular position to an angular position corresponding to the orientation desired for the drilling axis A6, as shown in FIG. 11.

Once the inclination desired for the device has been reached, the retraction pivoting ESC of the module 25 is stopped by the electronic and computer system. The device is then in the configuration shown in FIG. 11.

Figure 12:
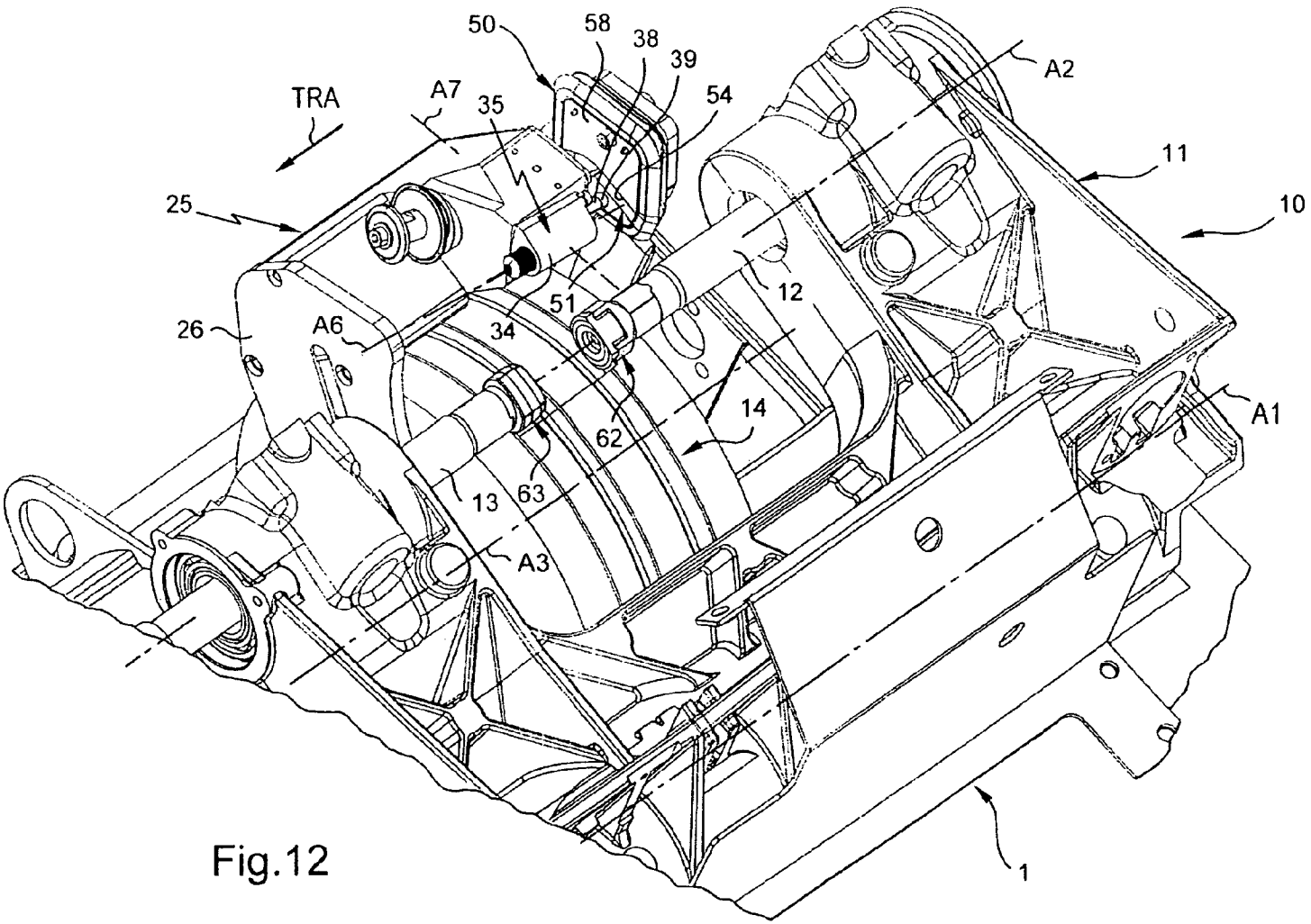
FIG. 12 is a perspective view analogous to FIG. 3 showing the disengagement of the adjustment finger of the drilling tool from the cam of the adjustment means, after orientation has been adjusted.

Finally, during a fifth and last step, referred to as a disengagement step, the electronic and computer system causes the grindwheels 14 to perform transfer movement TRA in translation so as to disengage the finger 38 from the cam plate 50, as shown in FIG. 12.

Thereafter, the drill 35, oriented in the manner that has just been adjusted, is held in that orientation by the braking action exerted by the piston 50 on the sleeve 40.

Another embodiment of the device and another implementation of the method of adjusting the orientation of the axis A6 of the drill bit 37 is shown in FIGS. 14 and 15. In this embodiment, elements of the edger that are identical to those of the embodiment described above and shown in FIGS. 1 to 13 are referenced using the same reference numerals.

Only the means for adjusting the orientation of the drill 35 are modified. These means comprise a lever 60 that is secured to the body 34 of the drill 35 and that extends longitudinally in a direction that is transverse to the swivel axis A7, forming an angle lying in the range 30° to 50° with the drill axis A6 of the drill bit 37. This lever 60 is suitable for coming into register with a stationary tilt abutment 61 associated with the structure 1 of the edger, after the module 25 has been brought into the appropriate position by its retraction movement ESC.

In order to place the lever 60 and the abutment 61 in a relative position for mutual engagement, the electronic and computer system controls pivoting movement ESC of the module 25 for this purpose. The lever 60 then extends obliquely relative to the transfer direction TRA.

Thereafter, the electronic and computer system causes the grindwheels 14 and the module 25 to perform transfer movement TRA in translation so that the lever 60 engages with the abutment 61, and by sliding on said abutment, causes the lever 60 to pivot by a ramp effect, thus causing the body 34 of the drill 35 that is secured thereto to pivot likewise. The transfer movement TRA is stopped when the drilling axis A6 reaches the desired orientation and the lever 60 is then disengaged from the abutment 61 by retracting pivoting ESC in the direction opposite to that that was used for engagement. It should be observed that this technique for adjusting the orientation of the drill bit, by the tilting-and-sliding action of the ramp lever 60 against the abutment 61 makes it possible to adjust orientation over a wide angular range and makes it possible in particular, not only to adjust the precise orientation of drilling accurately on the normal to the front face of the lens, but also to cause the drill to pivot by as much as 110° from its initial position parallel to the axis A2 so as to be able to drill the edge surface of the lens with accuracy adjusted orientation in a drilling direction that is substantially parallel to the midplane of the lens (between the planes that are tangential to the front and rear faces of the lens) in the drilling zone.

Once the orientation of the axis A6 of the drill has thus been determined, the lens is then drilled.

For this purpose, the electronic and computer system operates retraction pivoting ESC of the module 25 so as to bring the module 25 into register with the lens L for drilling. More precisely, the retraction movement ESC is controlled so as to position the bit 37 of the drilling tool 35 relative to the lens L for drilling in such a manner that the drilling axis A6 of the bit 37 coincides with the axis desired for the drilled hole, appropriately positioned and oriented relative to the lens L.

This then amounts to performing relative advance movement in translation of the drilling tool 35 relative to the lens L for drilling substantially along the drilling axis 35 of the bit 37 over a working advance stroke C suitable for drilling the lens L. For this purpose, a combination is made of only two movements of the drilling tool 35 relative to the lens L for drilling: transfer movement TRA and reproduction movement RES.

The first component of drilling advance is thus obtained by using transfer movement TRA which consists in moving the grindwheels 14 in axial translation along the axis A3 which is also substantially parallel to the axis A2 of the lens L for drilling. It can be seen that this transfer axis A3 is stationary and cannot be modified as a function of the orientation of the drilling axis A6. In other words, the transfer direction TRA is distinct and independent from the orientation of the drilling axis A6. Consequently, on the usual assumption where the drilling axis A6 is not parallel to the axis A3 (which a priori applies when drilling along a normal to the surface of the lens at the point of drilling), implementing this movement in translation TRA on its own would not suffice to achieve suitable advance along the drilling axis. It is necessary to "compensate" the angle formed between the direction of the axis A3 of this transfer TRA and the direction of the drilling axis A6. If no such compensation is performed, the drilling would be oblong, and of uncontrolled shape, and the angle of attack against the surface of the lens would be of a kind that would lead to material being torn from its surface.

This difference in orientation between the drilling axis A6 and the transfer axis A3 is compensated by combined relative transverse displacement of the lens L relative to the drilling tool 35 in translation or in tilting in a direction that is substantially perpendicular to the swivel axis A7 for the drilling axis A6. In order to obtain this relative transverse displacement, the electronic and computer system specifically causes the rocker 11 to perform reproduction pivoting RES.

In the embodiment shown, the reproduction transverse displacement RES is accompanied by unwanted displacement E along the swivel axis A7 of the drilling tool 35. Nevertheless, provision is made for this unwanted displacement to remain less than 0.2 mm, and preferably less than 0.1 mm over the working advance stroke C.

In FIG. 13, there can be seen a diagram showing the dynamics of drilling. The plane of FIG. 13 is perpendicular to the axis A2 of the lens. On this figure, seen edge-on in the plane of the figure, there can be seen the traces:

- of the surface S(A2), in this case a cylindrical surface, that is described by the axis A2 of the lens L during transverse displacement RES of the lens L relative to the drilling tool 35; and
- of the drilling plane P(A6) described by the drilling axis A6 of the drilling tool on pivoting about the swivel axis A7.

The unwanted transverse displacement E along the swivel axis A7 is constituted by the distance between the plane P(A6) and the surface S(A2). This unwanted displacement is at its maximum in this example at the end of the stroke C, where it is identified by the reference Emax.

During drilling, i.e. while the module 25 is in the drilling position on its retraction movement ESC, the axis A7 for swivelling the drilling axis A6 of the drilling tool 35 is arranged in such a manner that the drilling plane P(A6) over the working drilling stroke C is close to the surface S(A2) described by the axis A2 of the lens.

It will be readily be understood that by minimizing the distance between the drilling plane P(A6) and the surface S(A2), the maximum unwanted displacement Emax is also minimized.

Specifically, provision is made here for arranging the swivel axis A7 of the drilling tool 35 so that the drilling plane P(A6):

is tangential to the surface S(A2) described by the axis A2 of the lens L; and/or presents, relative to the surface S(A2) described by the axis of the lens L, a maximum offset of 0.2 mm and preferably of less than 0.1 mm over the working advance stroke C.

In a variant, provision can be made for the reproduction transverse displacement RES to be accompanied by no unwanted displacement along the swivel axis A7 of the drilling tool 35. To do this, it suffices, for example, to modify the dynamics of the reproduction movement RES of the shafts 12, 13 carrying the lens so that this movement consists in pure translation without any tilting.

It is important to observe that the electronic and computer system avoids triggering any rotation ROT of the lens L about the axis A2. The shafts 12 and 13 thus remain stationary in rotation while drilling is taking place. In a variant, provision could be made for the electronic and computer system to cause the shafts 12, 13 to turn about the axis A2 in application of a dynamic function that is independent of the orientation of the drilling axis, e.g. by implementing rotation ROT at a speed that is constant and depends solely on the rate of reproduction pivoting RES of the rocker 11 and/or the speed of transfer movement in translation TRA of the grindwheels 14 and of the module 25.

Finally, the electronic and computer system causes the retraction movement ESC to be performed in order to store the module 25 under its cover.

The invention claimed is:

1. A device for adjusting the orientation of the working axis (A6) of a working tool (35), said working tool being in rotation about said working axis to work an ophthalmic lens, said adjustment being about at least one swivel axis (A7) extending substantially transversely to said working axis, the lens being secured to a support that is rotationally drivable by a drive about a lens rotation axis, the device comprising:

pivot means enabling the working axis (A6) of the working tool (35) to perform pivoting movement (PIV) about said at least one swivel axis relative to said axis of rotation of the lens support; and adjustment means for adjusting the angular position of the working tool (35) about said at least one swivel axis;

the device including first movement means for enabling the working tool (35) to move relative to the lens (L) to be drilled with a first degree of freedom in movement (ESC; TRA) distinct from the pivoting (PIV) of the working axis (A6) of the working tool (35) about said at least one swivel axis, and additionally, said adjustment means are arranged to control pivoting (PIV) of the working axis (A6) of the working tool (35) about said at least one swivel axis by means of said first degree of freedom in relative movement of the working tool (35) relative to the lens (L), which is to be drilled.

2. A device according to claim 1, including second movement means for enabling the working tool to move relative to the lens with a second degree of freedom in movement (TRA; ESC) distinct from the pivoting of the working axis (A6) of the working tool (35) about said at least one swivel axis and from said first degree of freedom in movement (ESC; TEA), and in which the adjustment means can be engaged and disengaged by using said second degree of freedom in movement (TRA; ESC) of the working tool (35) relative to the lens (L) to be drilled.

3. A device according to claim 2, in which the adjustment means comprise a first portion (38) associated with the working tool (35), and a second portion (50) independent of the working tool (35), these two portions being engageable and disengageable relative to each other by means of said second degree of freedom in relative movement (TRA; ESC).

4. A device according to claim 2, in which said first degree of freedom in movement (ESC) is substantially transverse to the working axis.

5. A device according to claim 4, in which the second degree of freedom in movement (TRA) is substantially axial, in a direction that is substantially parallel to the rotation axis of the lens.

6. A device according to claim 2, in which said first degree of freedom in movement (TRA) is substantially axial, in a direction that is substantially parallel to the rotation axis of the lens.

7. A device according to claim 6, in which said second degree of freedom in movement (ESC) is substantially transverse to the working axis.

8. A device according to claim 2, in which the working tool (35) is carried by a body (34) that is mounted to pivot about the at least one swivel axis (A7) on a module (25) that is itself movable relative to the lens firstly with said first degree of freedom in movement, and secondly with said second degree of freedom in movement.

9. A device according to claim 8, in which said body is mounted on a grindwheel shaft to pivot about the axis of rotation of said shaft, said pivoting about the axis of rotation of the shaft constituting one of said degrees of freedom in movement.

10. A device according to claim 1, in which a body (34) of the working tool (35) is provided with an adjustment finger or lever (38; 60) that is substantially transverse to the at least one swivel axis (A7).

11. A device according to claim 1, in which said adjustment means comprise a cam or a ramp (51; 60).

12. A device according to claim 1, in which the adjustment means include stop means (50) for preventing pivoting of the working tool about said at least one swivel axis.

13. A device according to claim 12, in which the stop means (50) for preventing pivoting of the working tool operate by friction braking of the pivoting of the working tool.

14. A device according to claim 13, in which the stop means of the working tool prevent pivoting of the tool for torque that is less than or equal to 30 newton-centimeters (Ncm).

15. A device for edging and working an ophthalmic lens that includes a device for adjusting the working direction in accordance with claim 1.

16. A device according to claim 15, comprising a grinder having:

one or more grindwheels mounted to rotate on a shaft substantially parallel to the rotation axis of the lens; and means for imparting relative movement in translation between the lens and grindwheel(s), said translation-imparting means constituting said first movement means.

17. A device according to claim 1, in which the working tool is a drilling tool.

* * * * *

UNITED STATES PATENT AND TRADEMARK OFFICE

CERTIFICATE OF CORRECTION

PATENT NO. : 7,975,355 B2
APPLICATION NO. : 11/665607
DATED : July 12, 2011
INVENTOR(S) : Nauche et al.

It is certified that error appears in the above-identified patent and that said Letters Patent is hereby corrected as shown below:

On the title page, please amend Item (73) to read as follows:

--(73) Assignee: Essilor International (Compagnie Generale d'Optique), Charenton-le-Pont, (FR)--

Signed and Sealed this
Sixteenth Day of August, 2011

David J. Kappos

David J. Kappos
*Director of the United States Patent and Trademark Office*